US005593205A

United States Patent [19]

Vanderminden, Sr. et al.

[11] Patent Number: 5,593,205

[45] Date of Patent: Jan. 14, 1997

[54] CANOPY CLAMP FOR A CHAIR

[75] Inventors: Robert D. Vanderminden, Sr.; Nathan Butler, both of Granville, N.Y.

[73] Assignee: Telescope Casual Furniture Co., Granville, N.Y.

[21] Appl. No.: 246,313

[22] Filed: May 18, 1994

[51] Int. Cl.[6] ..... A47C 7/66

[52] U.S. Cl. ..... 297/184.15; 403/390; 403/396; 24/335; 24/339; 135/96

[58] Field of Search ..... 297/184.15, 184.13; 24/335, 339, 569; 135/96; 403/389, 385, 390, 397, 396

[56] References Cited

U.S. PATENT DOCUMENTS

| | | | |
|---|---|---|---|
| 632,858 | 9/1899 | Waibel et al. | 24/335 X |
| 1,419,288 | 6/1922 | Miller | 403/385 X |
| 2,426,975 | 9/1947 | Roach | 403/396 X |
| 3,050,280 | 8/1962 | Regan | 135/96 X |
| 3,749,429 | 7/1973 | Hauber | 403/389 X |
| 4,030,748 | 6/1977 | Brock | 135/96 X |
| 4,097,169 | 6/1978 | Kelly | 403/396 X |
| 4,293,162 | 10/1981 | Pap et al. | 297/184.15 X |
| 4,300,798 | 11/1981 | Musgrove et al. | 297/184.15 |
| 4,536,102 | 8/1985 | Doyle | 403/390 |
| 4,858,990 | 8/1989 | Combs-Rose | 297/184.15 |
| 4,865,381 | 9/1989 | Van Rogue | 297/184.15 |
| 4,919,379 | 4/1990 | Goetz | 24/569 X |
| 5,000,210 | 3/1991 | Worthington, Jr. | 297/184.15 X |
| 5,441,067 | 8/1995 | James et al. | 135/96 |

FOREIGN PATENT DOCUMENTS

| | | | |
|---|---|---|---|
| 1259525 | 1/1968 | Germany | 135/96 |
| 2029490 | 3/1980 | United Kingdom | 403/396 |

*Primary Examiner*—Peter M. Cuomo
*Assistant Examiner*—David E. Allred
*Attorney, Agent, or Firm*—McAulay Fisher Nissen Goldberg & Kiel, LLP

[57] ABSTRACT

The clamp for securing a canopy to a beach chair has a pair of metal plates fixedly secured to a cross-piece of the canopy. In addition, the clamp employs a plastic strap between the two metal plates for engaging with the tubular cross-piece of the chair under the biasing force of the adjacent metal plate. A nut member of trilobular shape is provided on a threaded bolt which passes through the metal plates and plastic strap to bias the metal plates towards each other. The large surface-to-surface contact provided by the strap provides a positive clamping action of the clamp on the tubular member of the chair.

15 Claims, 2 Drawing Sheets

CANOPY CLAMP FOR A CHAIR

This invention relates to a clamp for a chair. More particularly, this invention relates to a clamp for mounting a canopy on an outdoor chair.

As is known, various types of chairs, chaises, and the like furniture, particularly beach chairs and sand chairs, have been provided with canopies in order to provide shade in sunny weather for an occupant. In some cases, for example, as described in U.S. Pat. Nos. 4,201,416 and 4,230,363, the canopies have been manufactured and/or sold separately from the chairs so as to be mounted on the chairs, as desired, by a user. In such cases, various types of clamps and mounting mechanisms have been employed for mounting the canopies onto the chairs and, particularly, on a backrest portion of a chair. Generally, the clamps and mounting mechanisms have been employed in pairs on opposite sides of a canopy so that the user must manipulate two clamps in order to secure a canopy in place. For example, in order to mount a canopy in place on a chair backrest, the user must manipulate one clamp on one side of the canopy and then the other clamp on an opposite side of the canopy. Also, in order to move the canopy from one shading position to another shading position, the user must first loosen each clamp, place the canopy in the desired position with one or both hands and then tighten each clamp to secure the canopy in place.

In order to reduce the manipulative steps required for mounting of a canopy on a chair or for adjustment of a canopy on a chair, attempts have been made to use a single clamp to secure the canopy to the chair frame. Generally, such clamps have employed a pair of metal plates which can each be secured at one end to a cross piece of the canopy and which have opposite ends to envelope a tubular cross-piece of the chair frame. In addition, a tightening means has been provided to squeeze the two metal plates together so as to clamp the cross-piece of the chair frame therebetween. However, the metal-to-metal contact between the plates of the clamp and the tubular cross-piece, particularly where each is made of aluminum, has not been sufficient to hold the canopy in an elevated position. For example, the weight of a towel dropped on the canopy while in a raised position is sufficient to cause the canopy to pivot downwardly. Likewise, a wind force on the canopy has been found to be sufficient to move the canopy from the desired position.

Attempts have also been made to utilize tapes within the recesses of the metal plates to improve the gripping action of the plates on a tubular member. However, during rotary adjustments of the canopy, it has been found that the tapes would peel off or roll off from the metal plates.

Accordingly, it is an object of the invention to provide an improved clamp for mounting a canopy on a chair or a like type of furniture.

It is another object of the invention to provide a relatively simple clamp for mounting a canopy on an outdoor chair.

It is another object of the invention to provide a single clamp on a canopy for mounting of the canopy on a chair.

It is another object of the invention to manipulate a canopy into different positions on an outdoor chair using a single clamp.

Briefly, the invention provides a clamp which is comprised of a pair of metal plates which can be mounted on a cross-piece of a canopy, a plastic strap disposed between the metal plates and means for biasing the plates towards each other to secure a tubular member of a chair between one of the plates and the plastic strap.

Typically, the metal plates of the clamp are fixedly mounted on the cross-piece member of the canopy at the time of manufacture. In this respect, each metal plate is secured at one end to the cross-piece member of the canopy so that the plates project in cantilevered manner while being disposed in spaced apart relation to each other. In addition, each plate is provided with an elongated recess of arcuate shape at the free end so as to be capable of enveloping a tubular cross-piece of a chair.

The plastic strap is freely mounted between the metal plates without being secured to the cross-piece member of the canopy and is disposed in facing relation to the recess of an opposed metal plate in order to receive the tubular cross piece of the chair therebetween.

The means for biasing the plates towards each other includes a threaded bolt which passes through the two metal plates and the strap and a nut member which is threaded onto the bolt and abutted against an outside of one of the plates. Thus, upon threading of the nut member onto the bolt, the plates are pressed towards each other. This, in turn, causes the cross piece of the chair to be clamped between the two metal plates and, more particularly, between the plastic strap and one of the metal plates while deforming the plastic strap about the cross piece. The nut member also has a trilobular shape in order to provide an enlarged finger-gripping area for manual turning of the member.

Because of the presence of the plastic strap in contact with the cross-piece of the chair, an improved gripping effect is obtained relative to a metal-to-metal contact which would otherwise occur between the two metal plates and the cross-piece.

The arcuate recess in each metal plate has the same radius of curvature as the tubular cross-piece of the chair. Thus, when the nut member has been loosened relative to the metal plates and the clamping force on the tubular cross-piece of the chair has been relaxed, the clamp may be rotated about the axis of the cross piece in a relatively easy free manner without scratching the finish on the cross-piece.

When in the clamped position, the metal plate contiguous to the plastic strap contacts the strap along two parallel lines at opposite sides of the arcuately deformed end of the strap. As a result, the clamping force transferred from the metal plate to the plastic strap is concentrated along the two parallel lines of contact thereby enhancing the gripping power of the clamp on the tubular cross-piece.

Any suitable means may be provided for securing the end of each metal plate of the clamp to the cross-piece member of the canopy. For example, a pair of rivets may secure the two metal plates directly to the cross-piece of the canopy in a permanently fixed manner. Of course, the clamp may be made as a separate member from the canopy, if desired and put in place when the need arises.

Typically, the canopy is provided with the clamp in place. When the canopy is to be mounted on a chair such as a foldable beach chair, the chair can be disposed in a folded condition or in an unfolded condition. In either case, the nut member of the clamp is loosened to a sufficient extent to permit the free ends of the two metal plates and the plastic strap to pass over a cross-piece of the chair, typically a tubular cross-piece of a back rest of the chair. Next, the nut member is tightened so as to bring the two metal plates towards each other thereby clamping the tubular cross-piece of the chair between the plastic strap and the opposite metal plate while arcuately deforming the strap about the tubular cross-piece, The tightening of the nut member is made using one hand.

In the event that one wishes to change the position of the canopy when in use, for example, to move the canopy into a different shading position, the single nut member is loosened, again using one hand, leaving the other hand of the user free to manipulate the canopy into the desired position. When the desired position has been attained, the nut member is tightened to an extent sufficient to fix the canopy in place.

Once the canopy has been clamped into position, towels may be dropped onto the canopy without the canopy moving from the clamped position under the weight of the towels.

These and other objects and advantages of the invention will become more apparent from the following detailed description taken in conjunction with the accompanying drawings wherein.

Figure 1:
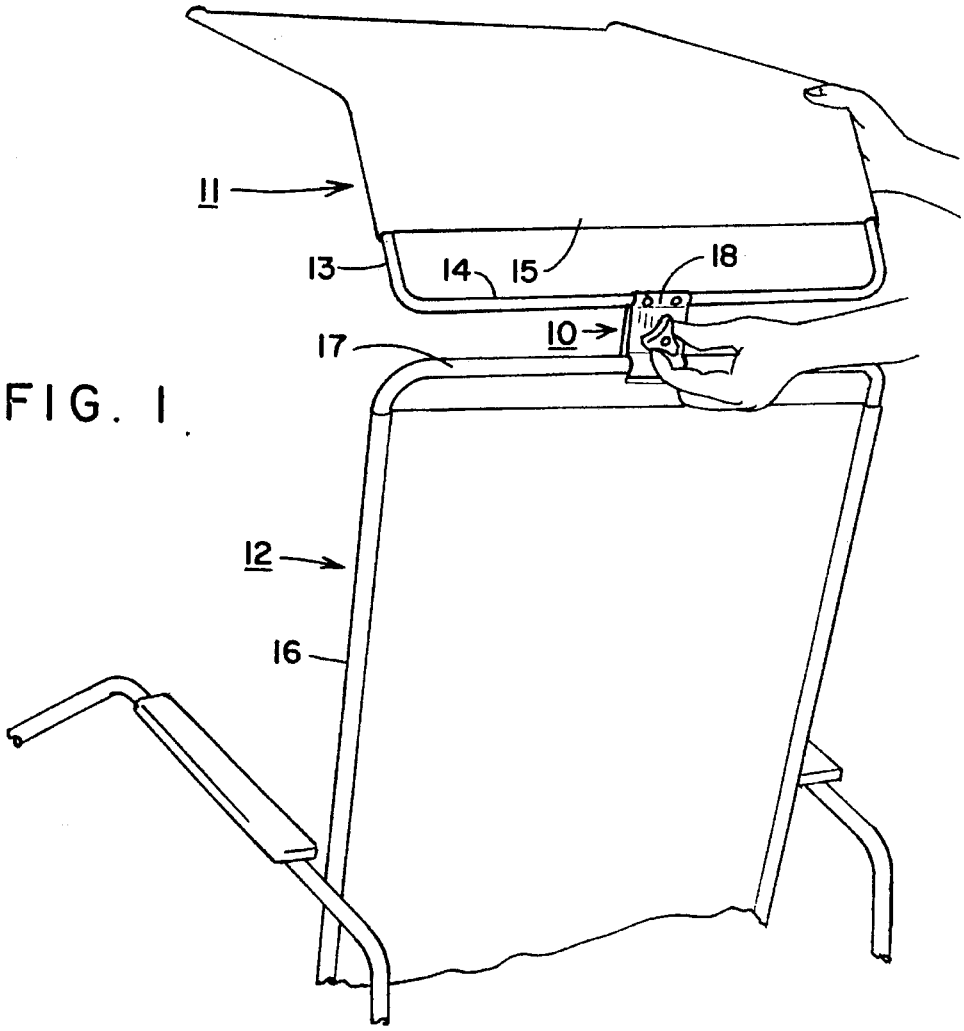
FIG. 1 illustrates a part perspective view of a canopy being mounted on a chair employing a clamp in accordance with the invention.

Referring to FIG. 1, the clamp 10 is secured centrally of a canopy 11 to mount the canopy 11 centrally on a chair 12, for example, a collapsible beach chair.

As indicated in FIG. 1, the canopy 11 is constructed in a conventional manner of a U-shaped frame 13 having a cross-piece member 14 of tubular shape, for example of cylindrical shape. In addition, a strip of material 15 is secured across the frame 13 to shade the area under the canopy 11. As indicated, the frame may be of angular shape, i.e. having a forward section in a horizontal plane and an inclined rear section.

The chair 12 includes a backrest frame 16 having a cross-piece 17 of tubular construction, for example of circular cross-section, at the upper end of the frame 16.

Figure 2:
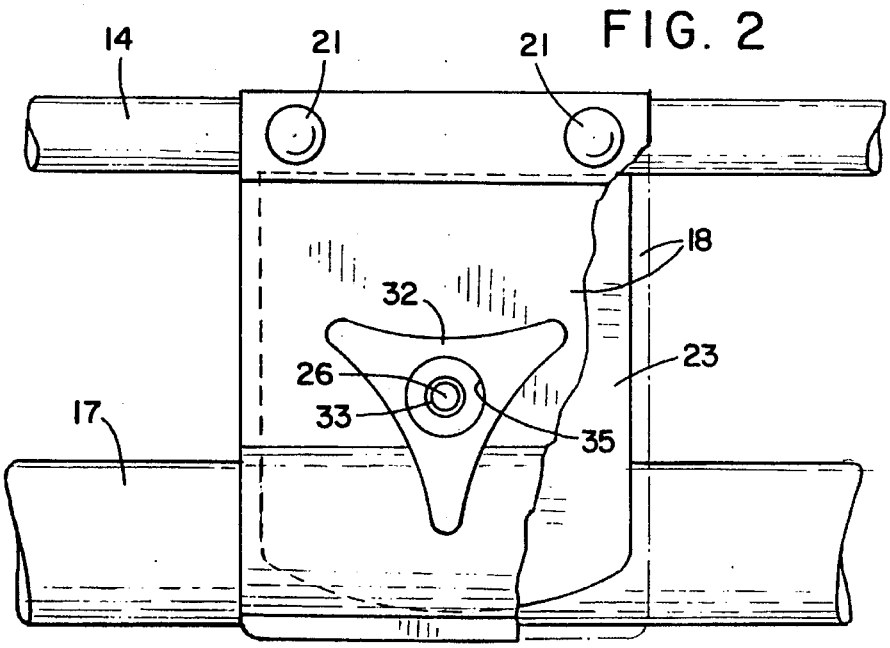
FIG. 2 illustrates a front view of the clamp of FIG. 1.
Figure 3:
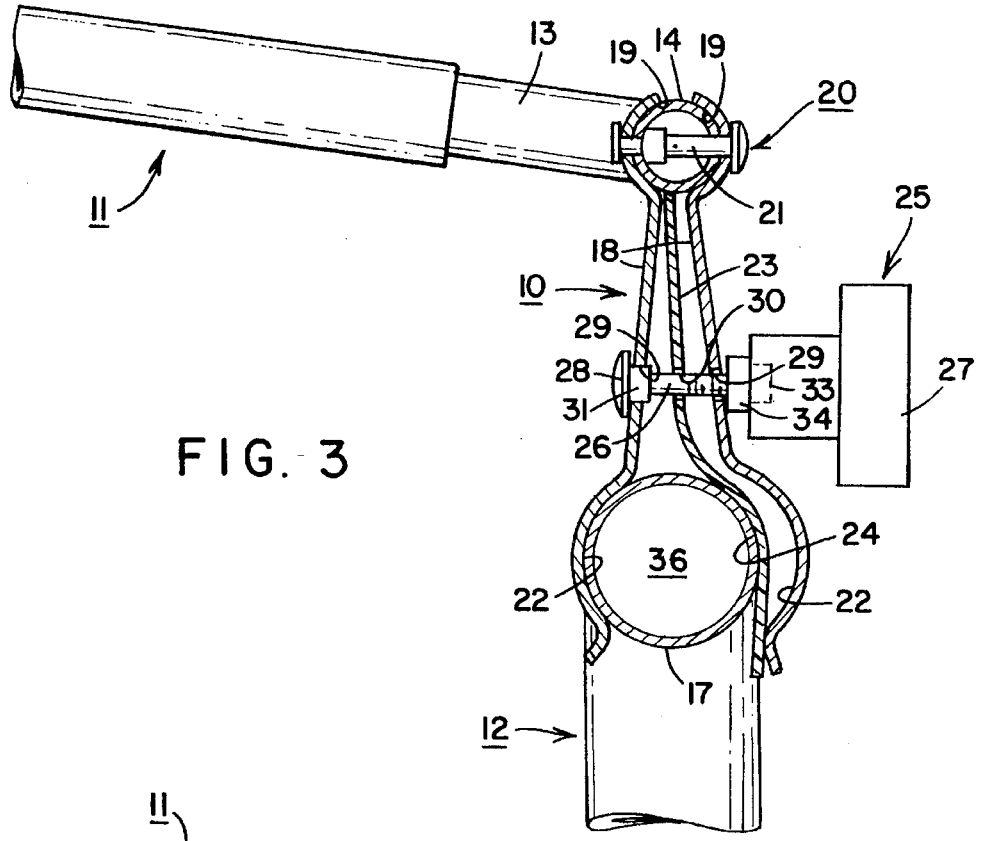
FIG. 3 illustrates a cross sectional view of the clamp of FIG. 1 relative to a canopy and chair combination in accordance with the invention.

Referring to FIGS. 2 and 3, the clamp 10 has a pair of metal plates 18 which are made, for example, of aluminum. Each plate 18 is of generally rectangular shape and has an arcuate recess 19 at one end which is sized to mate with the outer contour of the cross-piece member 14 of the canopy 11. As indicated, a means 20 is provided for securing the ends of the plates 18 to the cross-piece member 14. This means 20 is in the form of a pair of rivets 21 which pass through the tubular member 14 and the recessed ends of the plates 18 to form a permanent fixed connection between the plates 18 and the tubular member 14.

As indicated in FIG. 3, the plates 18 of the clamp 10 project in a cantilevered manner from the tubular member 14 of the canopy 11. In addition, the free end of each plate 18 has an elongated recess 22 of arcuate shape. The plates 18 are also disposed in spaced apart relation so as to be readily passed over the tubular cross-piece 17 of the chair 12.

Referring to FIGS. 2 and 3, a plastic strap 23 is freely disposed between the two metal plates 18. This plastic strap 23 is of generally rectangular shape and has an arcuate recess 24 at one end to fit about the cross-piece 17 of the chair 12. The strap 24 may be of any suitable plastic, such as polyvinylchloride (PVC) but should not be of a plastic which is too slippery, for example, polyethylene. Of course, any other suitable type of material may also be used for the purposes intended.

A means 25 is also provided for biasing the metal plates 18 towards each other in order to secure the tubular member 17 of the chair 12 therebetween. This biasing means 25 includes a threaded bolt 26 and a nut member 27. As indicated in FIG. 3, the threaded bolt 26 has a head 28 at one end and passes through an opening 29 in each metal plate 18 and an opening 30 in the plastic strap 23. For example, the openings 29 in the plates 18 may be of rectangular shape to receive a similar rectangular shaped section 31 of the bolt 26. In this way, the bolt 26 is restrained from rotating within the plate 18. In this regard, it is noted that the plates 18 are duplicates of each other so as to be interchangeable in position.

Of note, passage of the bolt 26 through the strap 23 serves to hold the strap 23 loosely within and between the metal plates 18.

The nut member 27 is constructed of a plastic housing 32 and a metal nut 33 which is received within a mating recess of the plastic housing 32 and which is threaded onto the bolt 26. The housing 32 and nut 33 are secured together to form a composite integrated member for common rotation relative to the bolt 26. In addition, a washer 34 is disposed between the nut member 27 and the adjacent metal plate 18.

As indicated in FIG. 2, the housing 32 has a trilobular shape in order to provide an enlarged finger-gripping area. In addition, a central recess 35 is formed in the housing 32 to receive the bolt 26.

Referring to FIG. 3, in order to mount the canopy 11 on the beach chair 12, the nut member 27 is unthreaded into a position which permits the metal plates 18 of the clamp 10 to move into a relaxed free-standing position. In this position, the plastic strap 23 is loosely received between the plates 18. Next, the free ends of the plates 18 and strap 23 of the clamp 10 are slipped over the tubular member 17 of the chair 12. At this time, as indicated in FIG. 1, the user may hold the canopy 11 in one hand in a desired position while the user's other hand turns the nut member 27 in a tightening direction until the clamping action of the clamp 10 is sufficient to hold the canopy 11 in place.

Figure 4:
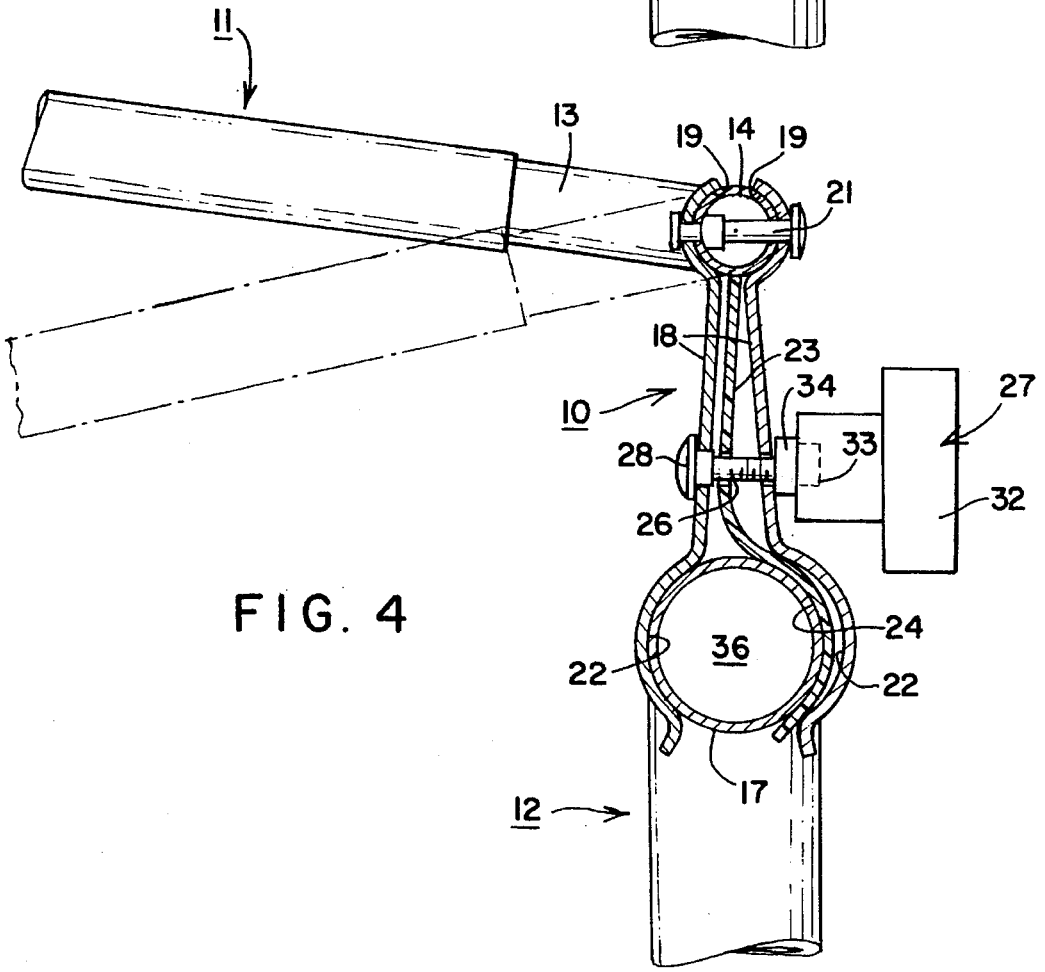
FIG. 4 illustrates a cross sectional view of the clamp of FIG. 1 in a clamped position.

Referring to FIG. 4, when the clamp 10 has achieved a clamping position, the tubular member 17 of the chair 12 is securely held between the plastic strap 23 and one metal plate 18 and, more particularly, between the recess 24 of the plastic strap 23 and the recess 22 of the plate 18. To this end, the recesses 22 of the plates 18 have a radius of curvature which is equal to the radius of curvature of the tubular member 17 of the chair 12. The end of the plastic strap 23, on the other hand, is arcuately deformed so as to have a radius of curvature which is slightly greater than the radius of curvature of the tubular member 17.

As indicated in FIG. 4, the metal plate 18 contiguous to the plastic strap 23 contacts the strap 23 along two parallel lines of contact. Thus, the clamping force of the metal plate 18 is transferred through two concentrated points onto the plastic strap 23. As such, the plastic strap 23 not only serves to transfer the concentrated clamping forces to the tubular member 17 of the chair 12 but also provides a relatively wide area-to-area contact between the strap 23 and the outer circumference of the tubular member 17.

The use of the plastic strap 23 between the metal plates 18 allows a positive secure, gripping action to take place between the clamp 10 and the tubular cross-piece 17 of the chair 12 which is sufficient to resist turning of the canopy 11 and clamp 10 on the tubular cross-piece 17, for example, under the weight of a towel on the canopy 11 or under a wind load.

Referring to FIG. 4, in order to change the position of the canopy 11, the nut member 27 can be backed-off the bolt 26, that is, loosened to such an extent as to permit the clamp 10 to be rotated about the axis 36 of the tubular member 17 of the chair 12. Once the canopy 11 has been moved into the desired position, the nut member 27 is again tightened to clamp the canopy 11 into place.

As indicated in FIG. 1, the clamp 10 is secured to the canopy 11 so that the clamp 10 is disposed in a vertical plane when the forward section of the canopy 11 is in a horizontal plane, that is, the clamp 10 is disposed in a plane perpendicular to the plane of the forward section of the canopy. In addition, the plates 18 and strap 23 of the clamp 10 are of a width, e.g. 2½ inches, sufficient to resist twisting or rocking of the canopy 11 about an axis perpendicular to the cross-piece 17 of the beach chair 12.

The invention thus provides a clamp of relatively simple construction which can be manipulated with one hand in order to secure a canopy to a chair frame.

In addition, the invention provides a single clamp for securing a canopy onto an outdoor chair frame in a stable manner. Further, the single clamp may be manipulated in a relatively simple manner to adjust the position of the canopy relative to the chair.

The use of the single clamp reduces the overall costs of manufacturing a canopy and chair combination while reducing the manipulative steps required to secure a clamp to a canopy and/or to secure a canopy in a desired position relative to a chair, for example for shading purposes.

What is claimed is:

1. A clamp comprising a pair of plates, each plate having an elongated recess of arcuate shape at one end in spaced facing relation to said recess in the other of said plates;

a plastic strap disposed between said plates, said strap being disposed in spaced facing relation to said recess of one of said plates to receive a tubular member therebetween while engaging the other of said plates; and means for biasing said ends of said plates towards each other to secure a tubular member between said one plate and said strap while said end of said other plate engages and deforms said strap about the tubular member.

2. A clamp as set forth in claim 1 wherein said means includes a threaded bolt passing through said plates and said strap and a nut member threaded onto said bolt and abutted against an outside of one of said plates.

3. A clamp as set forth in claim 2 wherein said nut member has a trilobular shape to provide an enlarged finger-gripping area.

4. In combination, a canopy having a cross-piece member;

a pair of metal plates disposed in spaced apart relation, each plate being secured at one end to said cross-piece member of said canopy and having a recess of arcuate shape at an opposite end;

a plastic strap disposed between said plates, said strap being disposed in spaced facing relation to said recess of one of said plates to receive a tubular cross-piece of a chair therebetween; and means for biasing said opposite ends of said plates towards each other to clamp the tubular cross-piece of a chair between said strap and said one plate while deforming said strap about the tubular cross-piece.

5. The combination as set forth in claim 4 wherein said means includes a threaded bolt passing through said plates and said strap and a nut member threaded onto said bolt and abutted against an outside of one of said plates.

6. The combination as set forth in claim 5 wherein said nut member has a trilobular shape to provide an enlarged finger-gripping area.

7. The combination as set forth in claim 4 which further comprises means securing said one end of each plate to said cross-piece member of said canopy.

8. In combination, a chair having a backrest with a tubular cross-piece;

a canopy having a cross-piece member; and a clamp secured to said cross-piece member of said canopy and removably clamped to said tubular cross-piece of said chair, said clamp including a pair of metal plates, each plate being secured at one end to said cross-piece member of said canopy and having an arcuate recess at an opposite end disposed about said tubular cross-piece of said chair, a plastic strap between one of said plates and said tubular cross-piece and means biasing said plates towards each other to clamp said tubular cross-piece between said strap and the other of said plates while deforming said strap about said tubular cross-piece of said chair.

9. The combination as set forth in claim 8 wherein said one plate contacts said strap along two parallel lines along said arcuate recess thereof.

10. The combination as set forth in claim 8 wherein said arcuate recess of each metal plate has a radius of curvature equal to the arcuate radius of said tubular cross-piece.

11. The combination as set forth in claim 8 wherein said means includes a threaded bolt passing through said plates and said strap and a nut member threaded onto said bolt and abutted against an outside of one of said plates.

12. The combination as set forth in claim 8 wherein said clamp is secured centrally of said cross-piece member and is clamped to a mid-point of said tubular cross-piece.

13. The combination as set forth in claim 8 wherein said canopy has a forward section for disposition in a horizontal plane over said chair and an inclined rear section having said cross-piece member therein, and said clamp is disposed in a plane perpendicular to said plane of said forward section.

14. The combination as set forth in claim 4 wherein said one plate contacts said strap along two parallel lines along said arcuate recess thereof to transfer a clamping force through two concentrated points onto said strap.

15. The combination as set forth in claim 14 wherein said arcuate recess of said one plate has a radius of curvature equal to a radius of curvature of said tubular cross-piece and said strap is arcuately deformed to have a greater radius of curvature than said one plate.

* * * * *